US009462390B2

(12) United States Patent
Lee et al.

(10) Patent No.: US 9,462,390 B2
(45) Date of Patent: Oct. 4, 2016

(54) DIAPHRAGM FOR SPEAKER, METHOD OF MANUFACTURING SAME, AND SPEAKER

(71) Applicant: AMOGREENTECH CO., LTD., Gimpo-si (KR)

(72) Inventors: Seung Hoon Lee, Paju-si (KR); Yong Sik Jung, Namyangju-si (KR); Yun Mi So, Daejeon (KR)

(73) Assignee: AMOGREENTECH CO., LTD. (KR)

( * ) Notice: Subject to any disclaimer, the term of this patent is extended or adjusted under 35 U.S.C. 154(b) by 0 days.

(21) Appl. No.: 14/612,478

(22) Filed: Feb. 3, 2015

(65) Prior Publication Data

US 2015/0146913 A1 May 28, 2015

Related U.S. Application Data

(62) Division of application No. PCT/KR2013/006837, filed on Jul. 30, 2013.

(30) Foreign Application Priority Data

Aug. 6, 2012 (KR) ..... 10-2012-0085766
Jul. 29, 2013 (KR) ..... 10-2013-0089634

(51) Int. Cl.

| | |
|---|---|
| ***H04R 9/06*** | (2006.01) |
| ***H04R 7/16*** | (2006.01) |
| ***H04R 9/02*** | (2006.01) |
| ***H04R 31/00*** | (2006.01) |

(52) U.S. Cl.
CPC ..... *H04R 7/16* (2013.01); *H04R 9/025* (2013.01); *H04R 31/003* (2013.01)

(58) Field of Classification Search
CPC ..... H04R 7/00; H04R 2307/025; H04R 2307/029
USPC ..... 381/426–428
See application file for complete search history.

(56) References Cited

U.S. PATENT DOCUMENTS

2008/0260188 A1 10/2008 Kim
2012/0148074 A1 6/2012 Bastiaens et al.

FOREIGN PATENT DOCUMENTS

| | | | | |
|---|---|---|---|---|
| KR | 1020070046473 | | 5/2007 | |
| KR | 1020080010071 | | 1/2008 | |
| KR | 1020110062216 | | 6/2011 | |
| KR | 1020110098577 | | 9/2011 | |
| KR | 1020110123909 | | 11/2011 | |
| KR | 10120100043392 | A * | 11/2011 | ..... B82B 3/00 |
| KR | 20130036432 | A * | 4/2013 | |

OTHER PUBLICATIONS

International Search Report—PCT/KR2013/006837 dated Nov. 27, 2013.

* cited by examiner

*Primary Examiner* — Sunita Joshi
(74) *Attorney, Agent, or Firm* — Cantor Colburn LLP

(57) ABSTRACT

Provided is a diaphragm for use in a speaker that is configured to include a nanoweb that is formed by electrospinning a polymer material and accumulating nanofibers, so as to have a plurality of pores through which air can pass. The diaphragm can be made thin, have excellent flexibility, have sufficient strength to endure sound pressure, and enhance sound quality of low pitched bands.

9 Claims, 2 Drawing Sheets

DIAPHRAGM FOR SPEAKER, METHOD OF MANUFACTURING SAME, AND SPEAKER

CROSS REFERENCE TO RELATED APPLICATIONS

This application is a divisional of International Application No. PCT/KR2013/006837, filed on Jul. 30, 2013, which claims priority to and the benefit of Korean Application Nos. 10-2012-0085766, filed on Aug. 6, 2012 and 10-2013-0089634, filed on Jul. 29, 2013 in the Korean Patent Office, the entire contents of which are incorporated herein by reference.

TECHNICAL FIELD

The present invention relates to a diaphragm used in a speaker, and more particularly, to a diaphragm for use in a speaker in which the diaphragm is manufactured in a nanoweb forms by an electrospinning method, a method of manufacturing the same, and a speaker using the diaphragm.

BACKGROUND ART

Typically, a speaker is a device for converting an electric signal into a voice signal and that is applied to a variety of acoustic equipment. In particular, since portable electronic equipment such as PDAs (personal digital assistants), notebook computers, communication terminals, portable terminals, MP3 players, netbooks, and so on, have a tendency of being made thin in thickness, the portable electronic equipment is made small in size and is provided with a thin micro-speaker.

Micro-speakers require an ultra-light/super-slim structure so as to be applied to the portable electronic equipment, and need to be able to regenerate a sound source as the original sound with high power and broadband.

These micro-speakers use respective thin film diaphragms having the lightweight and flexibility to give high-power and slim-type. These thin film diaphragms should be made thin in thickness thus enabling flexible movement, and should be designed to have wavy wrinkles, thereby increasing the entire surface area of each of the diaphragms.

However, as the amplitude of vibration of the thin film diaphragm grows, the pressure exerted on the diaphragm increases. Thus, the thin diaphragm is prone to breakage, and has the difficulty in making wavy wrinkles thereon.

As disclosed in Korean Patent Registration No. 10-0834075 (May 26, 2008), a conventional speaker diaphragm is configured to include: a polyethylene-based mesh plate having a number of holes; and a thermoplastic elastomer film that is thermally compressed on the polyethylene-based mesh plate, to thus block a plurality of holes formed on the polyethylene-based mesh plate, thereby realizing strong wear-resistance and lowering the minimum resonance frequency even with the thin film.

However, since the conventional speaker diaphragm is produced by thermal compression of the mesh plate and the thermoplastic elastomer film, there is a limit in thinning the speaker diaphragm. In addition, the speaker diaphragm may be deformed during performing thermal compression, and the manufacturing process is complicated.

SUMMARY OF THE INVENTION

To solve the above problems or defects, it is an object of the present invention to provide a diaphragm for a speaker and a manufacturing method thereof, in which the diaphragm is manufactured in a nanoweb form by an electrospinning method, so as to be made thin, to have excellent flexibility, and to have a strength enough to withstand the sound pressure.

It is another object of the present invention to provide a diaphragm for a speaker and a manufacturing method thereof, in which the diaphragm is manufactured in a nanoweb form by an electrospinning method, so as to be made in a light and soft structure to thereby improve the sound quality problems of low pitched bands.

It is another object of the present invention to provide a diaphragm for a speaker and a manufacturing method thereof, in which the diaphragm is manufactured in a nanoweb form having a plurality of pores by an electrospinning method, so as to enable a certain degree of air to pass through the pores, to thereby improve sound quality formed in housings of conventional speakers.

The technical problems to be solved in the present invention are not limited to the above-mentioned technical problems, and the other technical problems that are not mentioned in the present invention may be apparently understood by one of ordinary skill in the art in the technical field to which the present invention belongs.

To accomplish the above and other objects of the present invention, according to an aspect of the present invention, there is provided a diaphragm for a speaker, the diaphragm comprising: a vibration main body made of nanofibers that are formed by electrospinning a polymer material, and that is formed in a nanoweb structure to thus generate sound by vibration; and a plurality of pores formed on the vibration main body of the nanoweb structure.

According to another aspect of the present invention, there is provided a speaker including a diaphragm, the speaker comprising: a housing; a magnetic circuit having an air gap and that is supported by the housing; a coil that is displaceably positioned in the air gap of the magnetic circuit; a vibration main body that is vibrated according to displacement of the coil, that is made of nanofibers that are formed by electrospinning a polymer material, and that is formed in a nanoweb structure to thus generate sound by vibration; and a plurality of pores formed on the vibration main body of the nanoweb structure.

According to still another aspect of the present invention, there is provided a method of manufacturing a diaphragm for a speaker, the method comprising the steps of: mixing a polymer material and a solvent at a certain mixture ratio, to thus prepare a spinning solution; and electrospinning the spinning solution to create nanofibers and accumulating the nanofibers, to thus form a vibration main body having a plurality of pores and that is formed in a nanoweb structure to thus generate sound by vibration.

As described above, the speaker diaphragm according to the present invention is manufactured in a nanoweb form by an electrospinning method, to thus have an advantage of being made thin, having excellent flexibility, and having a strength enough to withstand the sound pressure.

Further, the speaker diaphragm according to the present invention is manufactured in a nanoweb form by an electrospinning method, to thus have an advantage of being made in a light and soft structure to thereby improve the sound quality problems of low pitched bands.

Further, the speaker diaphragm according to the present invention is manufactured in a nanoweb form having a plurality of pores by an electrospinning method, have an advantage of enabling a certain degree of air to pass through the pores, to thus make air passages formed in housings of conventional speakers unnecessary and to thereby improve sound quality.

DETAILED DESCRIPTION OF THE INVENTION

Figure 1:
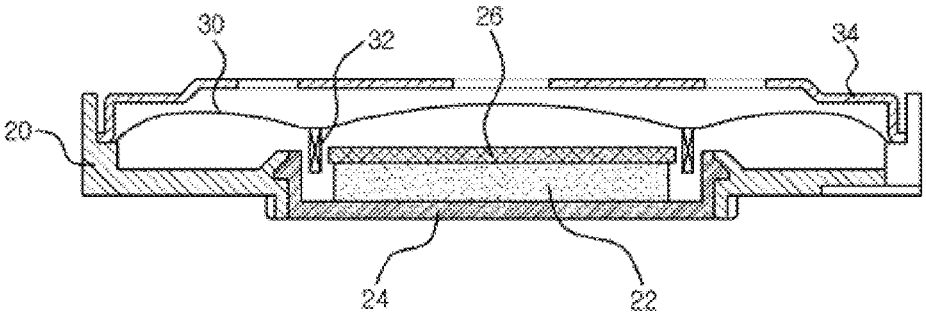
FIG. 1 is a cross-sectional view of a speaker according to the present invention.

Embodiments of the present invention will be described below in detail with reference to the accompanying drawings. Here, the size or shape of the components illustrated in the drawings may be shown to be exaggerated for convenience and clarity of illustration. In addition, specifically defined terms may be changed according to the intention or practices of users or operators in consideration of the construction and operation of the present invention. The definition of the terms should be made based on contents throughout the present specification.

FIG. 1 is a cross-sectional view of a speaker according to an embodiment of the present invention. Referring to FIG. 1, the speaker includes: a housing 20 with an inner space in the inside thereof; a magnet 22 that is embedded in the housing 20; a yoke 24 forming a magnetic circuit together with the magnet 22; a top plate 26 attached to the magnet 22 and forming the magnetic circuit together with the magnet 22; a diaphragm 30 that is fixed on the inner peripheral surface of the housing 20; a voice coil 32 that is fixed to the lower end of the diaphragm 30; and a protective plate 34 covering the open top of the housing 20 and formed on at least one sound passing hole.

Here, a bobbin (not shown) is provided and fixed to the diaphragm 30 and the voice coil 32 is wound on the outer periphery of the bobbin. Then, the magnet 22 is magnetized in the vertical direction, and the magnetizing direction can be variously applied with respect to the performance and structure of the speaker.

When current with the sound information flows in the voice coil 32, the voice coil 32 receives the force to move due to the influence of the current flowing in the voice coil 32 and a magnetic field generated from the magnet 22, and the diaphragm 30 connected to the voice coil 32 vibrates to thus generate sound.

That is, the speaker according to an embodiment includes: a housing 20; a magnetic circuit having an air gap and that is supported by the housing; a coil 32 that is displaceably positioned in the air gap of the magnetic circuit; a vibration main body that is vibrated according to displacement of the coil 32, that is made of nanofibers that are formed by electrospinning a polymer material, and that is formed in a nanoweb structure to thus generate sound by vibration; and a plurality of pores formed on the vibration main body of the nanoweb structure.

Further, the diaphragm 30 may have a structure that a metal film or a nonwoven fabric may be laminated on the nanoweb structure, in order to adjust the audio bands of the speaker.

The above-described speaker structure of FIG. 1 is nothing but an embodiment of the present invention. In addition to the above-described speaker structure, various types of speakers may be applied in the present invention, in which each speaker is provided with a speaker diaphragm of a nanoweb structure, and the speaker structure may be changed in various forms. Then, the diaphragm 30 may be provided in various forms such as circular, elliptical, rectangular, and centrally opened shapes.

Figure 2:
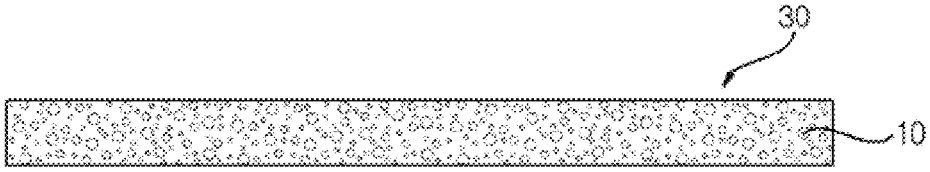
FIG. 2 is a cross-sectional view of a diaphragm for a speaker according to a first embodiment of the present invention.
Figure 3:
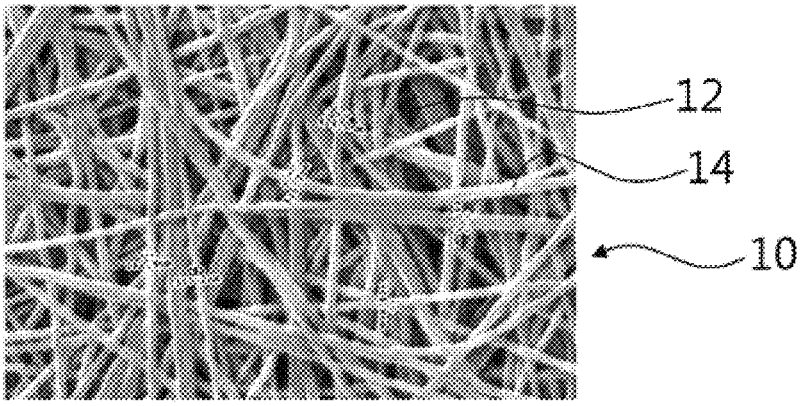
FIG. 3 is an enlarged view of the diaphragm for a speaker according to the first embodiment of the present invention.

FIG. 2 is a cross-sectional view of a diaphragm for a speaker according to a first embodiment of the present invention, and FIG. 3 is an enlarged view of the diaphragm for a speaker according to the first embodiment of the present invention.

A diaphragm 30 for a speaker according to a first embodiment is formed in a nanoweb structure 10 having a plurality of pores 12 by electrospinning a polymer material. The speaker diaphragm of the nanoweb structure 10 is configured by laminating the electrospun nanofibers and arranging the laminated electrospun nanofibers in a three-dimensional network structure, to thus have a strength sufficient to withstand a high level of a sound pressure and improve durability thereof.

Further, the speaker diaphragm 30 of the nanoweb structure 10 may enhance flexibility of the diaphragm 30, by the nanofibers that arranged in a three-dimensional network structure and three-dimensional nano-sized fine pores 12 formed by the nanofibers. That is, the diaphragm 30 may be variously modified according to a structure of the speaker. In other words, the diaphragm 30 of the flexible nanoweb structure 10 is possible to bend to be formed into a curved surface, and thus the diaphragm 30 may be modified in various forms.

Further, the speaker diaphragm 30 of the nanoweb structure 10 is formed by laminating and arranging the nanofibers of the spun polymeric material. In the present invention, to improve the performance of the speaker, the diaphragm 30 can be implemented in a laminated structure of a plurality of nano webs having different diameters of the nanofibers. That is, when it is assumed that the diaphragm 30 is implemented in a laminated structure where a first nanofiber web and a second nanofiber web are laminated on each other, the diameters of nanofibers in the first nanofiber web may be designed relatively larger than those in the second nanofiber web, and thus a first average pore size of the first nanofiber web may be larger than that in the second nanofiber web. Accordingly, as the shape of the flow path through which the air passes may be changed through the pores of the diaphragm 30, the design of the diaphragm can be variously changed in terms of improvement of sound quality.

In the present invention, the diaphragm 30 can be defined as a vibration main body of a nanoweb structure, which generates sound by vibration and has a plurality of pores formed on the vibration main body of the nanoweb structure.

In the present invention, the speaker diaphragm 30 of the nanoweb structure 10 includes three-dimensional nano-sized fine pores made of an array of the laminated nanofibers. Since air flows through three-dimensional nano-sized fine pores, the sound generated from the diaphragm 30 has a unique characteristic. That is, the sound generated from the speaker having the diaphragm 30 of the nanoweb structure 10 is different from the sound generated from the conventional speaker having the diaphragm with no three-dimensional network structure pores. Here, since the nanofibers are irregularly arranged in a three-dimensional network structure, the plurality of pores 12 produced by the nanofibers are formed three dimensionally irregularly.

Meanwhile, the diaphragm 30 of the nanoweb structure 10 is formed in a nanoweb shape, having a plurality of pores 12, by mixing a polymer material and a solvent at a certain mixture ratio, to thus prepare a spinning solution; and electrospinning the spinning solution to create nanofibers 14 and accumulating the nanofibers 14.

Here, the spinning method that is applied to the present invention can employ any one selected from general electrospinning, air-electrospinning (AES), electrospray, electrobrown spinning, centrifugal electrospinning, and flash-electrospinning.

In other words, the nanoweb structure 10 according to the present invention may be formed by using any spinning method of various spinning methods capable of making nanofibers in an accumulated form.

For example, the polymer materials used to make the nanoweb structure 10 in the present invention may be: polyvinylidene fluoride (PVdF), poly(vinylidene fluoride-co-hexafluoropropylene), a perfluoropolymer, polyvinyl chloride, polyvinylidene chloride, or a copolymer thereof; a polyethylene glycol derivative containing polyethylene glycol dialkylether and polyethylene glycol dialkylester; poly (oxymethylene-oligo-oxyethylene); polyoxide containing polyethylene oxide and polypropylene oxide; polyvinyl acetate, poly(vinyl pyrrolidone-vinyl acetate), polystyrene, and a polystyrene acrylonitrile copolymer; a polyacrylonitrile copolymer containing polyacrylonitrile (PAN) and a polyacrylonitrile methyl methacrylate copolymer; or polymethyl methacrylate, a poly methyl methacrylate copolymer, or a mixture thereof.

Here, since the diaphragm 30 is formed in the nanoweb structure 10 by spinning the spinning solution by the electrospinning method to thus create nanofibers 14, and accumulating the nanofibers 14, the thickness of the diaphragm 30 is determined according to a dose of the spun spinning solution. Accordingly, the diaphragm 30 may be easily prepared at a desired thickness.

Further, since the diaphragm 30 is formed in the nanoweb structure 10 where nanofibers are accumulated by the electrospinning method, the tensile strength of the diaphragm 30 is strong and thus a phenomenon that the diaphragm 30 is torn due to the sound pressure can be prevented. The diaphragm 30 is made thin to thereby have excellent flexibility, and to thus enhance sound quality of low pitched bands.

Further, since the diaphragm 30 is formed in the nanoweb structure 10 where nanofibers are accumulated by the electrospinning method, the diaphragm 30 is formed to have a plurality of pores 12. These pores 12 act as air passages to thus remove air passages formed in the existing housing, and thus air can pass through the pores 12. When the diaphragm 30 moves rapidly, the pores 12 plays a role of holding the diaphragm 30, to thus enhance the sound quality and prevent the diaphragm 30 from being damaged due to the excessive sound pressure.

Further, sizes of the pores 12 can be adjusted depending on the dose of the spinning solution, or the diameters of nanofibers, a variety of pore sizes can be made depending upon the capacity of the speaker.

Figure 4:
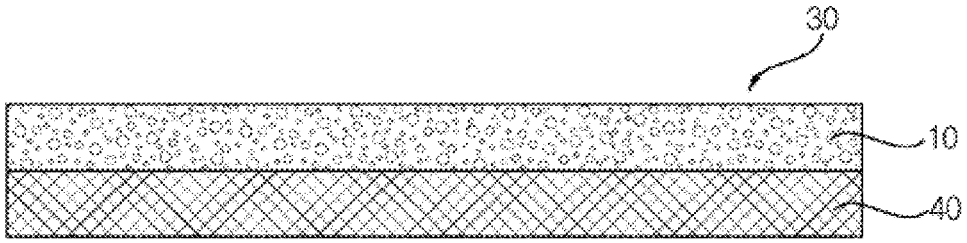
FIG. 4 is a cross-sectional view of a diaphragm for a speaker according to a second embodiment of the present invention.

FIG. 4 is a cross-sectional view of a diaphragm for a speaker according to a second embodiment of the present invention. Referring to FIG. 4, the diaphragm 30 according to the second embodiment includes: a base film 40; and a nanoweb 10 that is laminated on one surface of the base film 40, and having a plurality of pores.

Here, any polymer material that is used when producing the diaphragm 30 generally can be used in the base film 40, and e.g., PET (polyethylene terephthalate) or PEEK (polyether ether ketone) may be used in the base film 40.

Since the nanoweb 10 is formed by spinning the polymer material directly on one surface or both surfaces of the base film 40 by the electrospinning device, it is not necessary to pass through a process of bonding the nanoweb 10 to the base film 40.

As such, the diaphragm 30 according to the second embodiment has the non-pore type base film 40 having no pores, and thus is applied in order to use a pore-free diaphragm.

Figure 5:
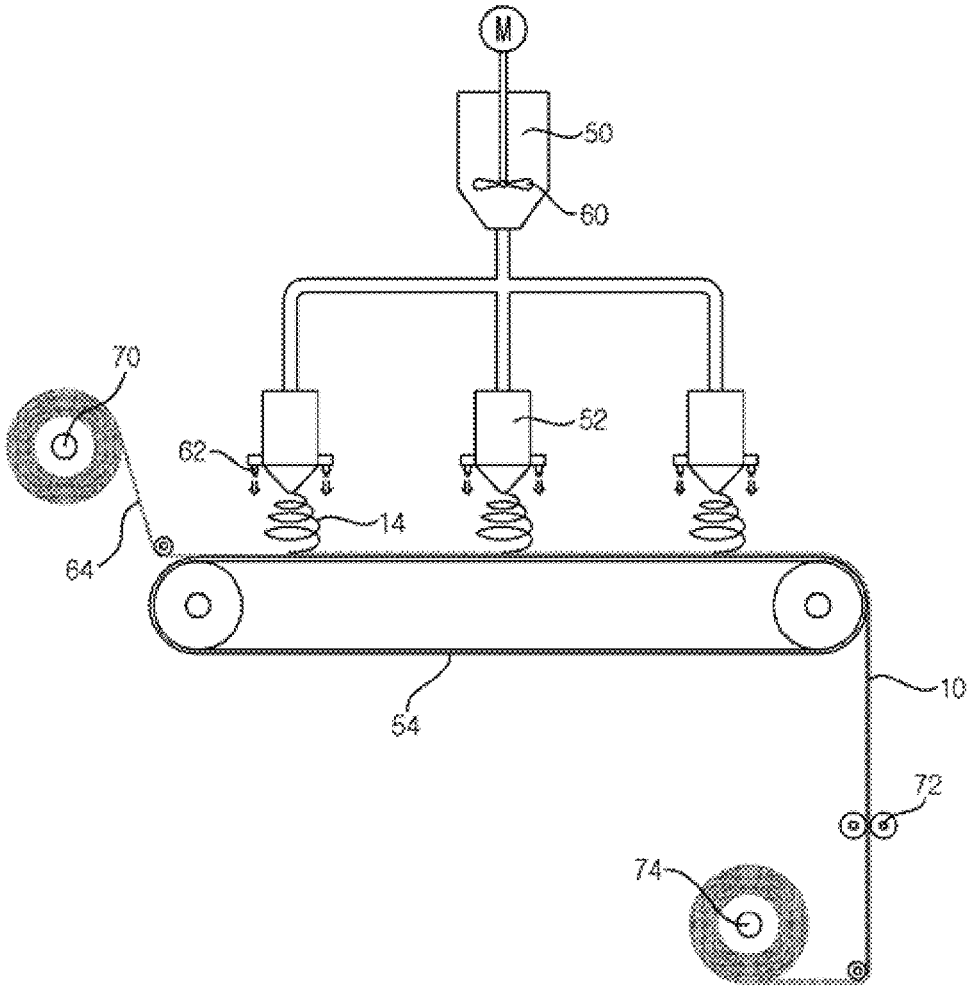
FIG. 5 is a configuration diagram of an electrospinning device for manufacturing a speaker diaphragm according to the present invention.

FIG. 5 is a configuration diagram of an electrospinning device for manufacturing a speaker diaphragm according to the present invention. Referring to FIG. 5, the electrospinning device according to the present invention includes: a mixing tank 50 in which a spinning solution that is obtained by a mixture of a polymer material and a solvent is stored; a spinning nozzle unit 52 that is connected to a high voltage generator and is connected to the mixing tank 50, to thus spin the spinning solution and form a nanoweb 10; and a collector 54 that is disposed at the lower side of the spinning nozzle unit 52 and that accumulates nanofibers 14.

The mixing tank 50 is provided with an agitator 60 that evenly mixes a polymer material and a solvent and maintains a constant viscosity of the spinning solution.

In addition, a high voltage electrostatic force of 90 to 120 Kv is applied between the collector 54 and the spinning nozzle unit 52, to thereby spin nanofibers 14. Accordingly, the nanofibers 14 are collected on the collector 54, to thereby form the nanoweb 10.

The spinning nozzle unit 52 is provided with an air spray apparatus 62, to thus prevent the nanofibers 14 spun from the spinning nozzle unit 52 from fluttering without being collected by the collector 54.

A conveyor or a table-shaped unit that automatically transfers the release film or the base film so that the nanoweb 10 is laminated on the release film or the base film 40 may be used as the collector 54.

A release film roll 70 is disposed in front of the collector 54, in which the release film 64 is wound on the release film roll 70, to allow the release film 64 to be supplied on top of the collector 54. In addition, a pressure roller 72 that pressurizes (or performs calendaring) the nanoweb to have a constant thickness is provided at the rear side of the collector 54. A nanoweb roll 74 is provided, around which the nanoweb 10 pressurized in a predetermined thickness via the pressure roller 72 is wound.

Here, in the case of manufacturing the diaphragm according to the second embodiment, the base film 40 is supplied to the collector 54, instead of the release film, and thus the nanoweb 10 is directly laminated on the base film 40.

A process for producing the diaphragm by using the electrospinning apparatus constructed as described above will be described as follows.

First, when the collector 54 is driven, the release film 864 wound on the release film roll 70 is released and supplied from the release film roll 70 to the collector 54.

Then, a high voltage electrostatic force is applied between the collector 54 and the spinning nozzle unit 52, and thus the polymer material is made into nanofibers 14 by the spinning nozzle unit 52 to then be spun to the surface of the release film 64. As a result, the nanofibers 14 are accumulated onto the surface of the release film 64 to thus form the nanoweb 10.

Here, when the spinning nozzle unit 52 spins the nanofibers 14, an air spray apparatus 62 mounted in the spinning nozzle unit 52 sprays air to the nanofibers 14, so that the nanofibers 14 can be collected and captured on the surface of the release film 64 without fluttering.

Further, the nanoweb 10 is pressed to a predetermined thickness while passing through the pressure roller 76 and is wound on the nanoweb roll 74 to then be kept in custody.

In addition to the above-described manufacturing method, in the case that the nanoweb is formed on the base film 40, the base film 40 is fed to the collector 54 instead of of release film 64 and thus the nanoweb is formed on the surface of the base film 40. Meanwhile, in the case that the nanoweb is formed on both surfaces of the base film 40, another electrospinning device is provided at the rear side of the collector and thus the nanoweb is formed on the other surface of the base film 40.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

The present invention provides a diaphragm for a speaker and a manufacturing method thereof, in which the diaphragm is manufactured in a nanoweb form by an electrospinning method, so as to be made thin, to have excellent flexibility, and to have a strength enough to withstand the sound pressure.

What is claimed is:

1. A speaker diaphragm, the speaker diaphragm comprising:

a vibration main body made of a polymer nanofiber web and generating sound by vibration of the polymer nanofiber web; and a plurality of pores formed on the vibration main body, wherein the polymer nanofiber web includes a first polymer nanofiber web and a second polymer nanofiber web laminated on the first nanofiber web, the first polymer nanofiber web being formed of a first polymer nanofiber having a first diameter and the second polymer nanofiber web being formed of a second polymer nanofiber having a second diameter smaller than the first diameter.

2. The speaker diaphragm according to claim 1, further comprising a base film laminated on the vibration main body.

3. The speaker diaphragm according to claim 1, wherein the polymer nanofiber web is formed a laminate of two or more polymer nanofiber layers.

4. The speaker diaphragm according to claim 3, wherein the laminate of the two or more polymer nanofiber layers form a three-dimensional network structure including the plurality of the pores.

5. The speaker diaphragm according to claim 1, wherein the plurality of the pores are configured to pass air.

6. The speaker diaphragm according to claim 1, wherein the vibration main body is flexible.

7. A speaker including a diaphragm, the speaker comprising:

a housing;

a magnetic circuit having an air gap and that is supported by the housing;

a coil that is displaceably positioned in the air gap of the magnetic circuit;

a vibration main body that is vibrated according to displacement of the coil, wherein the vibration main body is formed of a polymer nanofiber web and generating sound by vibration of the polymer nanofiber web; and a plurality of pores formed on the vibration main body, wherein the polymer nanofiber web includes a first polymer nanofiber web and a second polymer nanofiber web laminated on the first nanofiber web, the first polymer nanofiber web being formed of a first polymer nanofiber having a first diameter and the second polymer nanofiber web being formed of a second polymer nanofiber having a second diameter smaller than the first diameter.

8. The speaker according to claim 7, wherein the vibration main body further includes a metal film or a nonwoven fabric laminated on the polymer nanofiber web.

9. A method of using a polymer nanofiber web as a speaker diaphragm, the method comprising the steps of:

mixing a polymer material and a solvent at a certain mixture ratio, to thus prepare a spinning solution;

obtaining a first polymer nanofiber web by electrospinning the spinning solution, the first polymer nanofiber web formed of a first polymer nanofiber having a first diameter;

obtaining a second polymer nanofiber web by electrospinning the spinning solution, the second polymer nanofiber web formed of a second polymer nanofiber having a second diameter smaller than the first diameter; and laminating the first polymer nanofiber web and the second polymer nanofiber web with each other, to thus form a vibration main body having a plurality of pores.

* * * * *